US008388304B2

(12) United States Patent
Liang et al.

(10) Patent No.: US 8,388,304 B2
(45) Date of Patent: Mar. 5, 2013

(54) TURBINE AIRFOIL COOLING SYSTEM WITH HIGH DENSITY SECTION OF ENDWALL COOLING CHANNELS

(75) Inventors: George Liang, Palm City, FL (US); Zhihong Gao, Orlando, FL (US); Brian J. Wessell, Orlando, FL (US); Joseph B. Gilliam, Deltona, FL (US)

(73) Assignee: Siemens Energy, Inc., Orlando, FL (US)

( * ) Notice: Subject to any disclaimer, the term of this patent is extended or adjusted under 35 U.S.C. 154(b) by 9 days.

(21) Appl. No.: 13/099,515

(22) Filed: May 3, 2011

(65) Prior Publication Data

US 2012/0282107 A1 Nov. 8, 2012

(51) Int. Cl.
*F03B 11/00* (2006.01)

(52) U.S. Cl. ..... 415/115; 415/211.2

(58) Field of Classification Search ..... 416/193 A, 416/189, 191; 415/115
See application file for complete search history.

(56) References Cited

U.S. PATENT DOCUMENTS

| | | | | |
|---|---|---|---|---|
| 6,210,111 | B1 | 4/2001 | Liang | |
| 7,597,536 | B1 | 10/2009 | Liang | |
| 7,621,718 | B1 | 11/2009 | Liang | |
| 7,695,247 | B1 * | 4/2010 | Liang | 416/97 R |
| 7,762,773 | B2 | 7/2010 | Liang | |
| 7,766,606 | B2 | 8/2010 | Liang | |
| 7,766,609 | B1 | 8/2010 | Liang | |
| 7,775,769 | B1 | 8/2010 | Liang | |
| 7,841,828 | B2 | 11/2010 | Liang | |
| 2008/0085190 | A1 | 4/2008 | Liang | |
| 2010/0124508 | A1 | 5/2010 | Liang | |
| 2010/0135772 | A1 | 6/2010 | Liang | |

* cited by examiner

*Primary Examiner* — Ninh H Nguyen
*Assistant Examiner* — Adam W Brown

(57) ABSTRACT

A cooling system for a turbine airfoil of a turbine engine having a trailing edge cooling region formed from endwall cooling channels having a higher density of cooling channels than other areas in order to cool the material forming the intersection between the trailing edge of the airfoil and the endwall to prevent premature cracking. The increased density of cooling channels in the endwall at the trailing edge forms a heat sink that draws heat from the airfoil, thereby lowering the temperature of the airfoil and increasing the useful life of the airfoil.

20 Claims, 5 Drawing Sheets

TURBINE AIRFOIL COOLING SYSTEM WITH HIGH DENSITY SECTION OF ENDWALL COOLING CHANNELS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine airfoils must be made of materials capable of withstanding such high temperatures. In addition, turbine airfoils often contain cooling systems for prolonging the life of the airfoils and reducing the likelihood of failure as a result of excessive temperatures.

Typically, turbine vanes are formed from an inner endwall at one end, an elongated portion forming a blade that extends outwardly from the inner endwall, and an outer endwall coupled to an outer end of the blade. The inner aspects of most turbine vanes typically contain an intricate maze of cooling channels forming a cooling system. The cooling channels in a vane receive air from the compressor of the turbine engine and pass the air through the vane. The cooling channels often include multiple flow paths that are designed to maintain all aspects of the turbine vane at a relatively uniform temperature. However, air flow at boundary layers often prevent some areas of the turbine airfoil from being adequately cooled, which results in the formation of localized hot spots. Localized hot spots, depending on their location, can reduce the useful life of a turbine airfoil and can damage a turbine vane to an extent necessitating replacement of the airfoil. Conventional cooling systems positioned in endwalls of turbine airfoils typically include internal cooling channels. While these cooling channels reduce the temperature of portions of the endwall, there exist drawbacks where the system does not effectively cool areas of the endwalls having relatively large mass. Thus, there exists a need for a turbine vane with an improved cooling system.

SUMMARY OF THE INVENTION

This invention is directed to a cooling system for a turbine airfoil of a turbine engine having a trailing edge cooling region positioned in an endwall and formed from endwall cooling channels having a higher density of cooling channels than other areas of the endwall in order to cool the material forming the intersection between the trailing edge of the airfoil and the endwall to prevent premature cracking. The increased density of cooling channels in the endwall at the trailing edge forms a heat sink that draws heat from the airfoil, thereby lowering the temperature of the airfoil and preventing premature cracking and other damage to the airfoil.

The turbine airfoil may be formed from a generally elongated, hollow airfoil having a leading edge, a trailing edge, an endwall coupled to a first end of the generally elongated, hollow airfoil and extending generally orthogonal to a longitudinal axis of the generally elongated, hollow airfoil, and a cooling system formed from at least one cavity in the elongated, hollow airfoil. A plurality of first endwall cooling channels may extend in the endwall from a line aligned with a midchord region of the generally elongated, hollow airfoil to a trailing edge of the first endwall, wherein the plurality of first endwall cooling channels are aligned with each other and have a density of first endwall cooling channels per unit area. A plurality of second endwall cooling channels may extend from the line aligned with the midchord region of the generally elongated, hollow airfoil to the trailing edge of the endwall. The plurality of second endwall cooling channels may be aligned with each other and have a density of second endwall cooling channels per unit area. The density of the second endwall cooling channels may be greater than the density of the first endwall cooling channels. In one embodiment, the density of second endwall cooling channels may be at least twice that of the density of first endwall cooling channels. In one embodiment, the trailing edge cooling region may be formed from at least eight endwall cooling channels.

The second endwall cooling channels may be positioned in a trailing edge cooling region in the endwall, whereby the trailing edge cooling region is at least partially aligned with the intersection between the trailing edge of the generally elongated, hollow airfoil and the endwall. The trailing edge cooling region in the endwall may include at least one second endwall cooling channel in the endwall generally aligned with a first side edge of the endwall. A centerline of the first and second endwall cooling channels may be positioned between a centerline of a thickness of the endwall and a radially outer surface of the endwall to which the airfoil is coupled. As such, the endwall cooling channels may cooling the endwall during use. In another embodiment, the endwall may include two generally hollow airfoils extending radially outward therefrom, and the endwall may include a trailing edge cooling region at a trailing edge of each of the generally hollow airfoils.

The trailing edge cooling region formed by second endwall cooling channels in the endwall may be defined by a plurality of second endwall cooling channels aligned with each other and positioned between a second endwall cooling channel positioned radially inward from an outer surface of a suction side of the airfoil and positioned between the trailing edge of the airfoil and a first side edge of the endwall closest to the suction side of the airfoil and a second endwall cooling channel positioned closer to an opposite second side edge of the endwall and between the trailing edge of the airfoil and the opposite second side edge. A width of the trailing edge cooling region taken in a direction extending from the first side edge of the endwall to the second side edge of the endwall may be between about two times a width of the trailing edge of the airfoil and about five times a width of the trailing edge of the airfoil. The trailing edge cooling region may be positioned such that a width of the trailing edge cooling region equal to about the width of one trailing edge of the airfoil is positioned in the endwall between the trailing edge of the airfoil at a suction side and the first side edge of the endwall, and the trailing edge cooling region is positioned such that a remainder of the width of the trailing edge cooling region extends from the trailing edge of the airfoil at the suction side towards the second side edge of the endwall.

An advantage of this invention is that the circumferential cooling air feed slot and high density, second endwall cooling holes provide additional cooling for the trailing edge cooling region, which translates to a cooler root section fillet metal temperature and higher material operation capacity.

Another advantage of this invention is that the increased density of the second endwall cooling channels positioned at the intersection between the trailing edge of the airfoil and the endwall reduces the trailing edge stiffness and enhances the airfoil low cycle fatigue capability.

Yet another advantage of this invention is the spent impingement cooling fluids collected in the impingement chamber provides additional cooling for the airfoil at the endwall and at the trailing edge fillet region before exit from the endwall. As such, the double use of the cooling fluids improves the efficiency of the airfoils.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
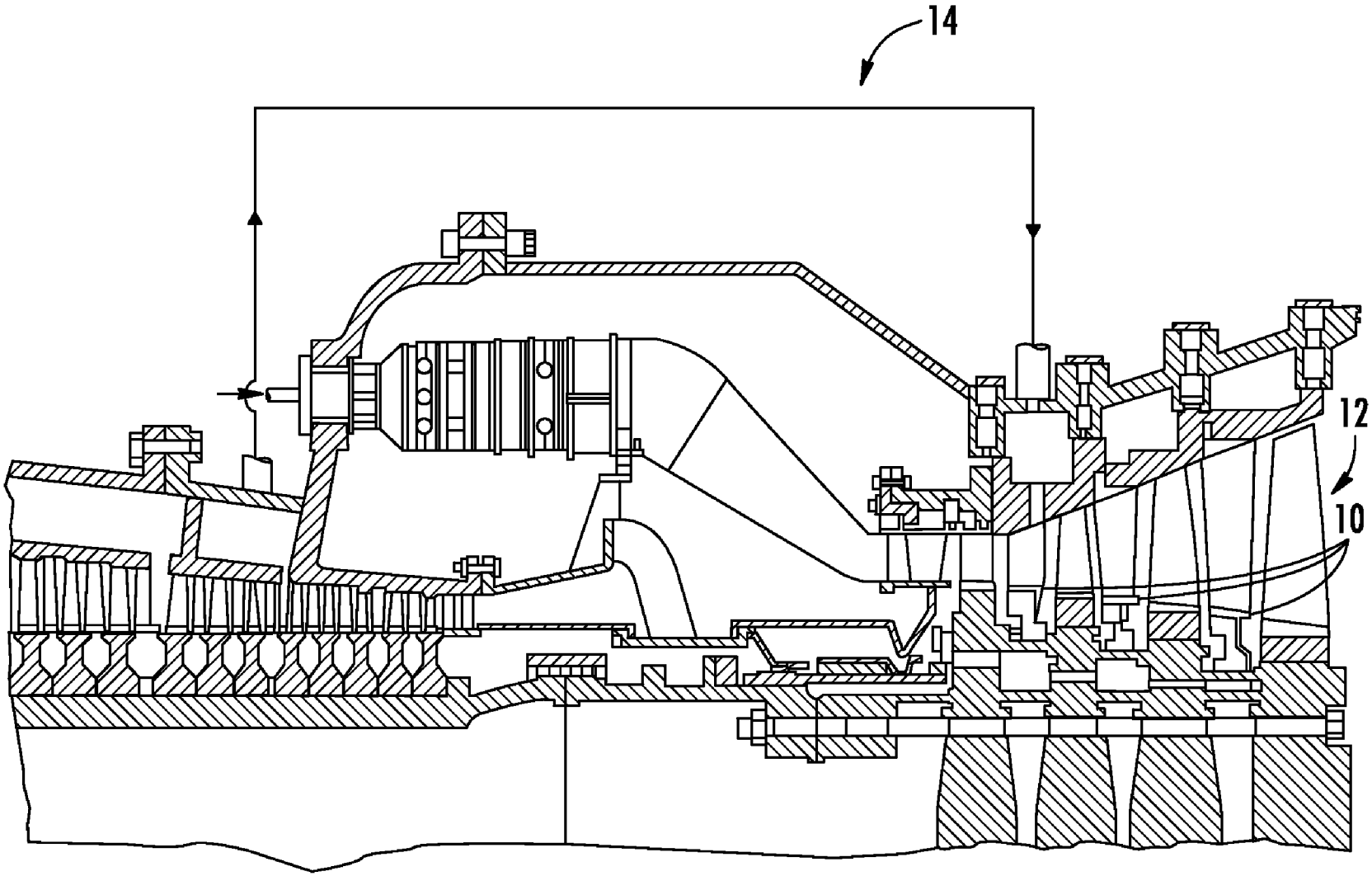
FIG. 1 is a cross-sectional view of a turbine engine having features according to the invention.
Figure 2:
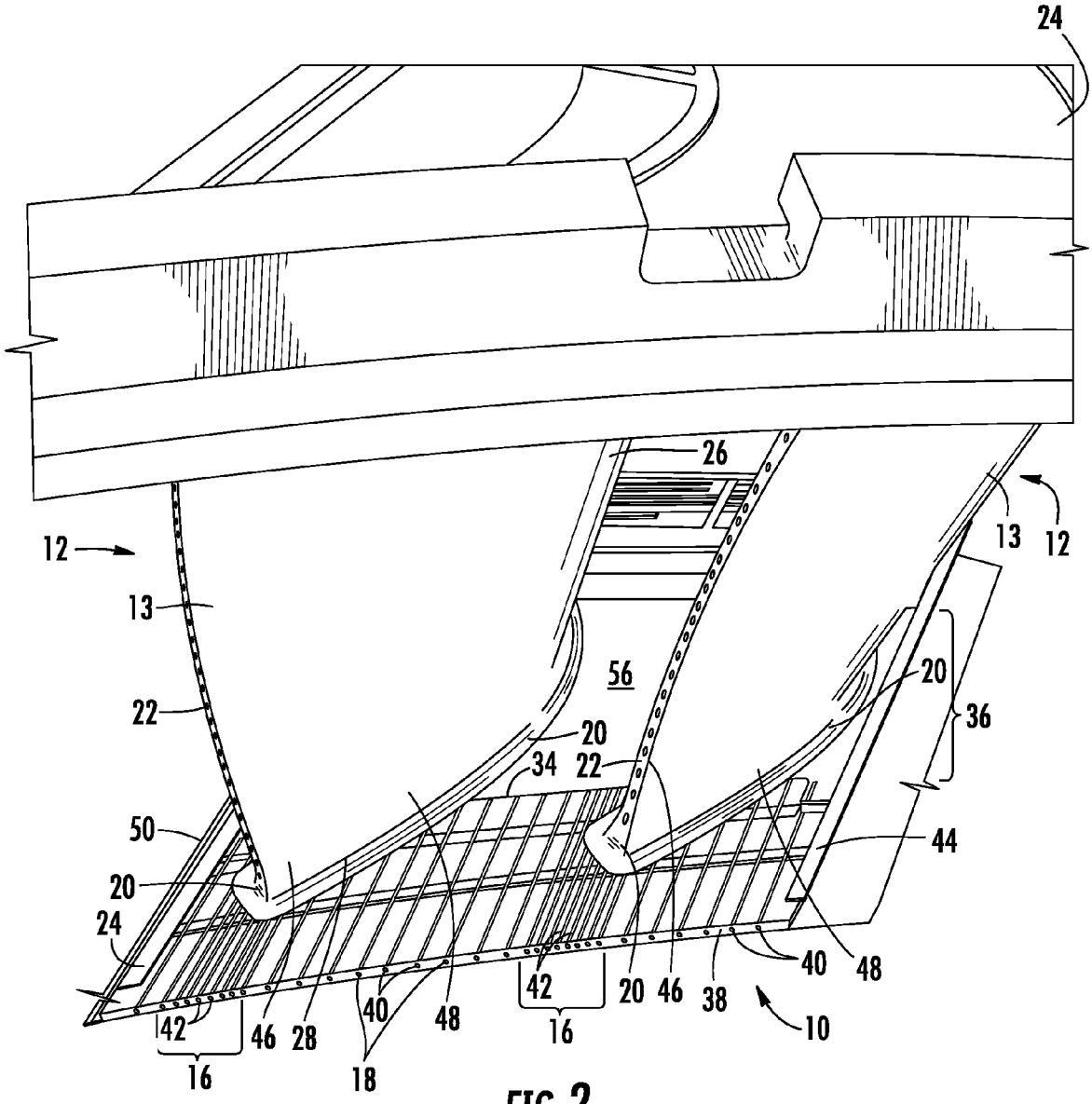
FIG. 2 is a partial perspective view with a partial cross-sectional view of an endwall with aspects of the cooling system of the invention.
Figure 3:
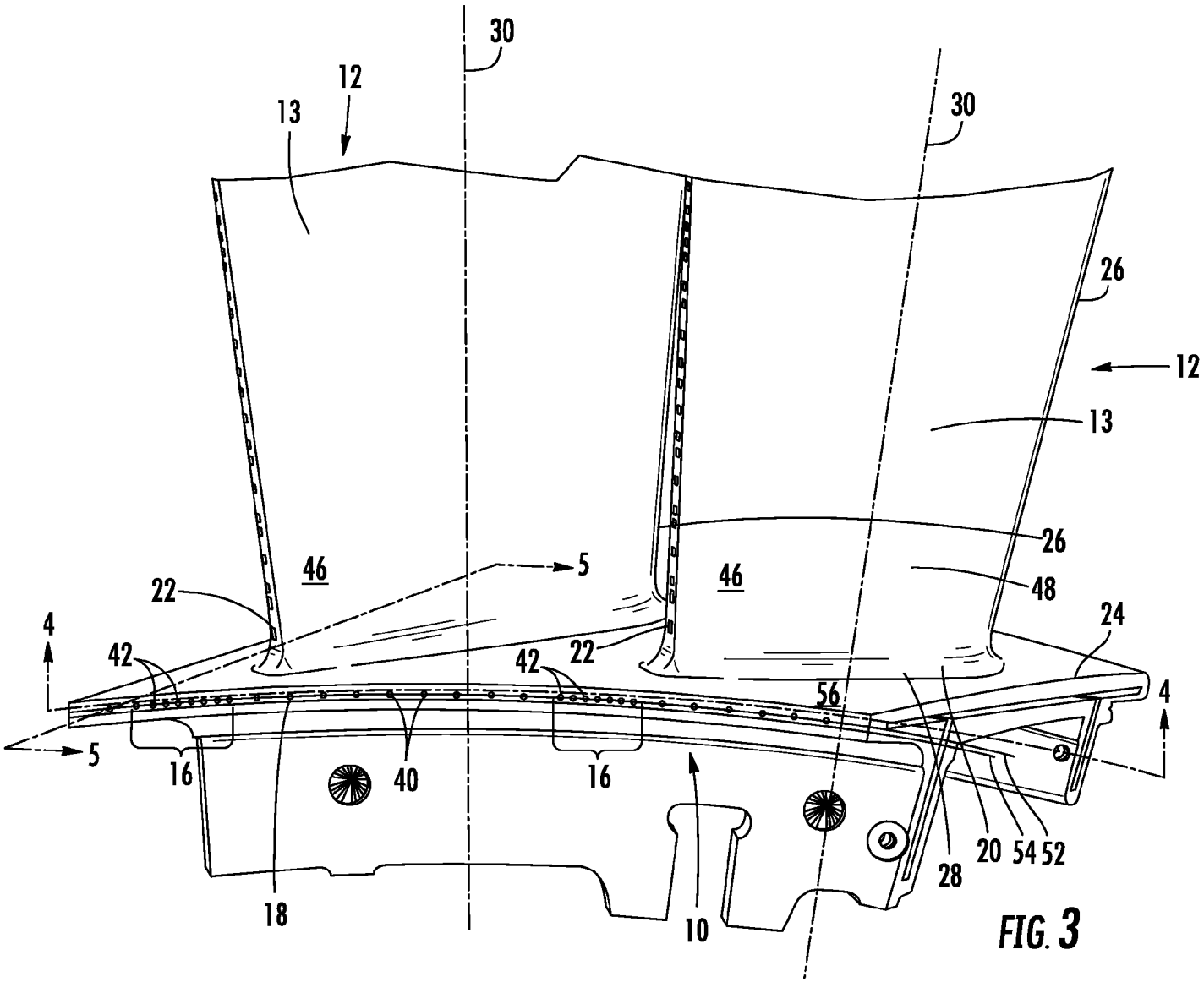
FIG. 3 is a perspective view of the endwall with turbine airfoils extending therefrom.

As shown in FIGS. 1-5, this invention is directed to a cooling system 10 for a turbine airfoil 12 of a turbine engine 14 having a trailing edge cooling region 16 positioned in an endwall 24 and formed from endwall cooling channels 18 having a higher density of cooling channels 18 than other areas in order to cool the material forming the intersection 20 between the trailing edge 22 of the airfoil 12 and the endwall 24 to prevent premature cracking. The increased density of cooling channels 18 in the endwall 24 at the trailing edge 22, as shown in FIGS. 2 and 3, forms a heat sink that draws heat from the airfoil 12, thereby lowering the temperature of the airfoil 12 at the location near the trailing edge cooling region 16 and preventing premature cracking and other damage to the airfoil 12.

As shown in FIGS. 2 and 3, the turbine airfoil 12 may be formed from a generally elongated, hollow airfoil 13 having a leading edge 26, a trailing edge 22, the endwall 24 coupled to a first end 28 of the generally elongated, hollow airfoil 13 and extending generally orthogonal to a longitudinal axis 30 of the generally elongated, hollow airfoil 13, and a cooling system 10 formed from at least one cavity 32 in the elongated, hollow airfoil 13. The cooling system 10 may include a plurality of first endwall cooling channels 40 extending in the endwall 24 from a line 34 aligned with a midchord region 36 of the generally elongated, hollow airfoil 13 to a trailing edge 38 of the endwall 24. The plurality of first endwall cooling channels 40 may be aligned with each other and have a density of first endwall cooling channels per unit area. The cooling system 10 may also include a plurality of second endwall cooling channels 42 extending from the line 34 aligned with the midchord region 36 of the generally elongated, hollow airfoil 13 to the trailing edge 38 of the endwall 24. The plurality of second endwall cooling channels 42 may be aligned with each other and may have a density of second endwall cooling channels per unit area. The second endwall cooling channels 42 may be positioned in a trailing edge cooling region 16 in the endwall 24. The density of the second endwall cooling channels 42 may be greater than the density of the first endwall cooling channels 40. In at least one embodiment, the density of second endwall cooling channels 42 may be at least twice that of the density of first endwall cooling channels 40. As shown in FIG. 3, the trailing edge cooling region 16 may include at least eight endwall cooling channels 42.

The trailing edge cooling region 16 may be at least partially aligned with the intersection 20 between the trailing edge 22 of the generally elongated, hollow airfoil 13 and the endwall 24. The trailing edge cooling region 16 in the endwall 24 may include at least one second endwall cooling channel 42 the endwall 24 generally aligned with a first side edge 44 of the endwall 24.

The trailing edge cooling region 16 of second endwall cooling channels 42 in the endwall 24 may be defined by a plurality of cooling channels 42 aligned with each other and positioned between a second endwall cooling channel 42 that is positioned radially inward from an outer surface 46 of the suction side 48 of the airfoil 12 and that is positioned between the trailing edge 22 of the airfoil 12 and a first side edge 44 of the endwall 24 closest to the suction side 48 of the airfoil 12 and a second endwall cooling channel 42 that is positioned closer to an opposite second side edge 50 of the endwall 24 and that is between the trailing edge 22 and the opposite second side edge 50. A width of the trailing edge cooling region 16 taken in a direction extending from the first side edge 44 to the second side edge 50 may be between about two times a width of the trailing edge 22 of the airfoil 12 and about five times a width of the trailing edge 22 of the airfoil 12. The trailing edge cooling region 16 may be positioned such that a portion of the width of the trailing edge cooling region 16 equal to about the width of one trailing edge 22 is positioned in the endwall 24 between the trailing edge 24 at the suction side 48 and the first side edge 44 of the endwall 24. In addition, the trailing edge cooling region 16 may be positioned such that a remainder of the width of the trailing edge cooling region 16 extends from the trailing edge 22 of the airfoil 12 at the suction side 48 towards the second side edge 50 of the endwall 24.

The first or second endwall cooling channels 40, 42, or both may also be positioned at various angles relative to the vane hot flow path, such as from 0 degrees to about 10 degrees. The first endwall cooling channels 40 may have a pitch to diameter ratio of about 8 to 10, where pitch is the distance between centerlines of adjacent endwall cooling channels. The cooling hole pattern may be sized to achieve that airfoil material life requirement for that portion of the endwall. The second endwall cooling channel 42 may have a pitch to diameter ratio of 2 to 3. The second endwall cooling channels 42 may be spaced from each other a distance of about 2D, which is two times the diameter of the second endwall cooling channels 42. The second endwall cooling channels 42 are formed in a closely packed formation that creates a greater overall internal convective area and heat transfer coefficient for the portion of the endwall 24 that houses the second endwall cooling channels 42. The enhanced cooling at the intersection 20 between the trailing edge 22 of the airfoil 12 and the endwall 24 further lower the metal temperature at the intersection 20 between the trailing edge 22 of the airfoil 12 and the endwall 24. The lower temperature translates to an increase material LCF capability.

The plurality of second endwall cooling channels 42 may form between about 40 percent and 50 percent of a width of the trailing edge 22 of the endwall 24. A number of first endwall cooling channels 40 may be equal to a number of second endwall cooling channels 42 in the endwall 24, whereby the first and second endwall cooling channels 40, 42 have equal diameters.

As shown in FIG. 3, the first or second endwall cooling channels 40, 42, or both, may be positioned such that a centerline 52 of the cooling channels 40, 42 is positioned between a centerline 54 of a thickness of the endwall 24 and a radially outer surface 56 of the endwall 24 to which the airfoil 12 is coupled. In at least one embodiment, the cooling channels 40, 42 may be positioned as close as possible to the radially outer surface 56.

As shown in FIG. 3, the endwall 24 may include two generally hollow airfoils 12 extending radially outward therefrom. The endwall 24 may include a trailing edge cooling region 16 aligned with a trailing edge 22 of each of the generally hollow airfoils 12.

Figure 4:
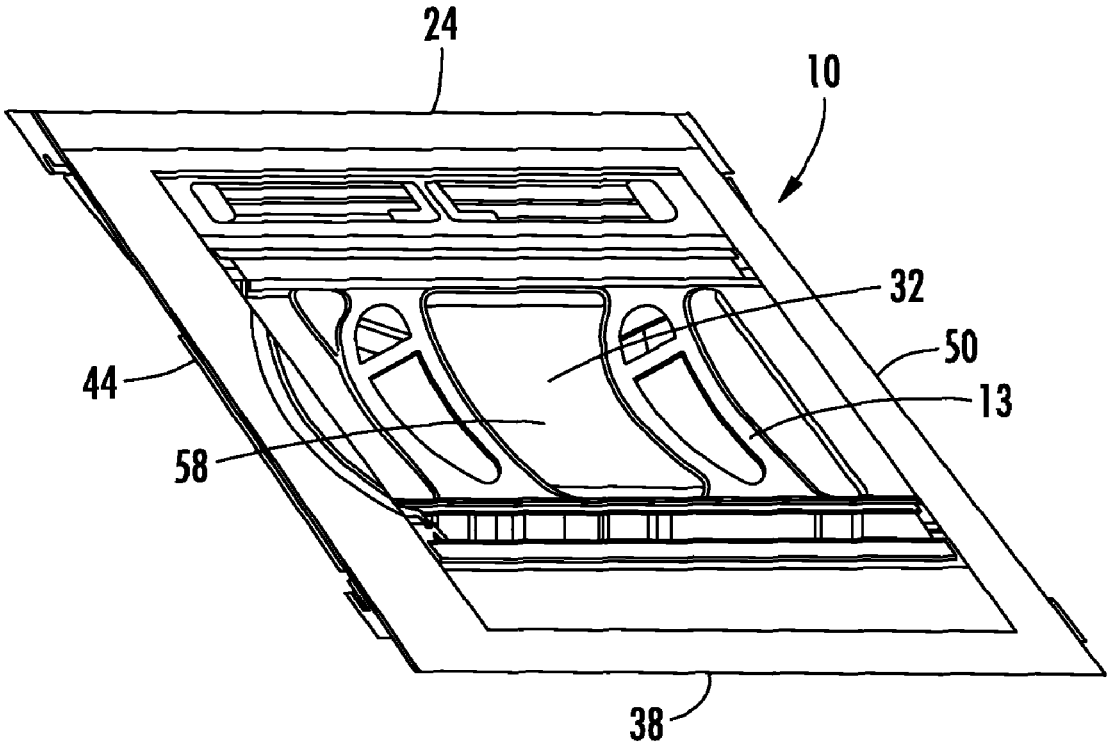
FIG. 4 is a cross-sectional view of the endwall shown in FIG. 3 taken along section line 4-4.
Figure 5:
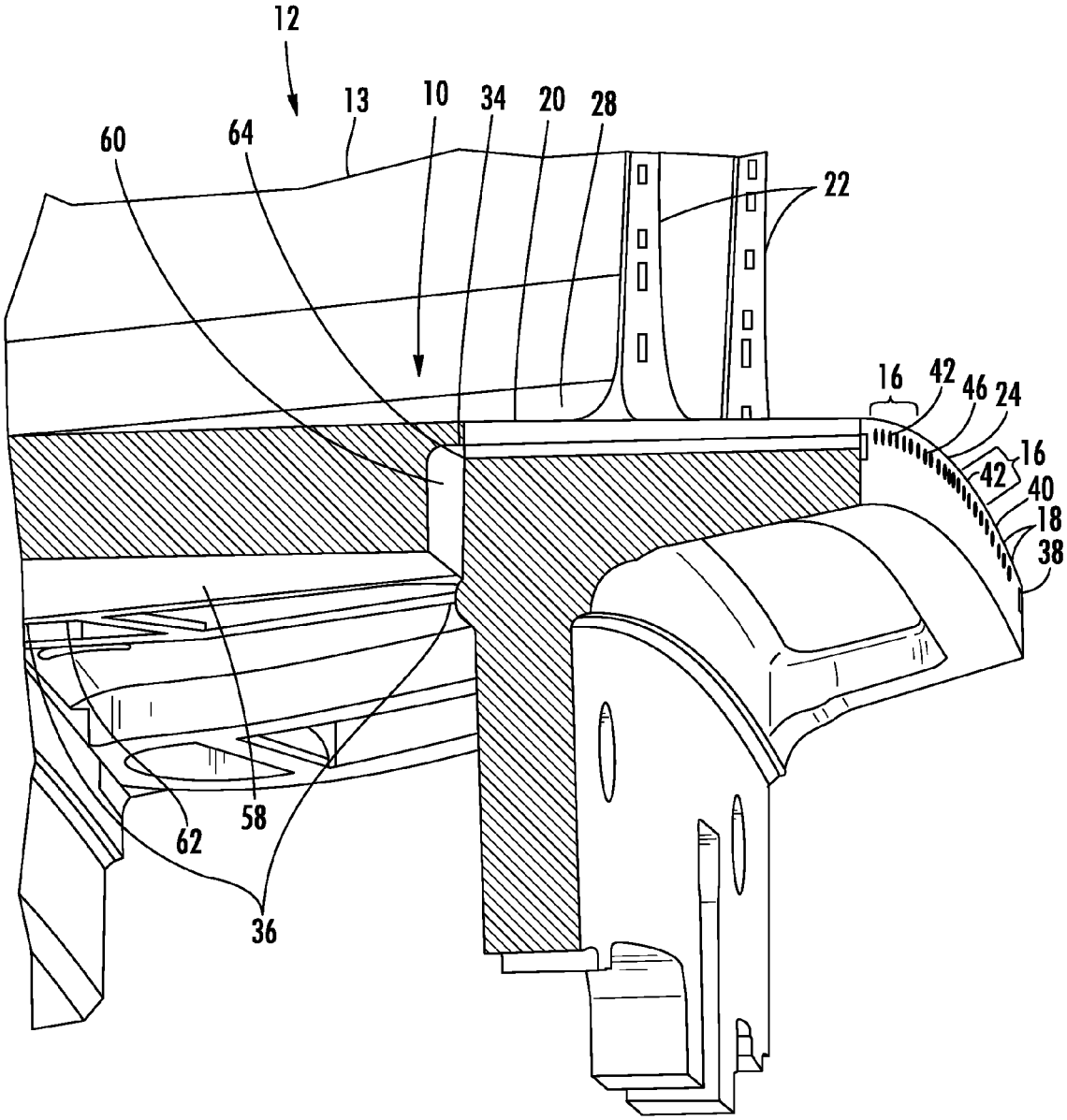
FIG. 5 is a cross-sectional view of the endwall shown in FIG. 3 taken along section line 5-5.

As shown in FIGS. 4 and 5, the cooling system 10 may also include an impingement chamber 58 positioned in the midchord region 36 of the endwall 24. The impingement chamber 58 may have any appropriate configuration and may be sized based on the cooling requirements of the cooling system 10. The impingement chamber 58 may capture cooling fluids after the cooling fluids have passed through the cooling system 10 in the turbine vane 12 and through an impingement plate positioned in the cooling system 10. A wall forming the downstream side of the impingement chamber 58 may form the line 34 from which the first and second endwall cooling channels 40, 42, extend. The impingement chamber 58 may be in fluid communication with the first and second endwall cooling channels 40, 42 through a circumferential cooling air feed slot 60. The circumferential cooling air feed slot 60 may extend radially outward from a downstream end 62 of the impingement chamber 58 to an upstream end 64 of the first and second endwall cooling channels 40, 42. The circumferential cooling air feed slot may be machined within the I.D. endwall post impingement chamber 58.

During use, cooling fluids may flow into the cooling system 10 from a cooling fluid supply source (not shown). More particularly, cooling fluids may be bleed off from the vane main body insert tube into the interstage seal housing. The cooling fluids may then impinge on the backside of the vane I.D. endwall first. A portion of the cooling fluid may then be discharged through a channel located at the endwall mateface to provided cooling thereto. The cooling fluid may also pass into the impingement chamber 58, pass into the circumferential cooling air feed slot 60 and into the first and second endwall cooling channels 40, 42. As the cooling fluids flow into the second endwall cooling channels 42, the cooling fluids provide a greater amount of cooling to the endwall 24 and airfoil 12 at the intersection 20 than in the endwall 24 in a section in which the first endwall cooling channels 40 are positioned. The first or second endwall cooling channels 40, 42 discharge the cooling fluids through the trailing edge 38 of the endwall 24. Thus, the cooling system 10 is configured to provide an increased cooling capability to a region surrounding the intersection 20 of the turbine airfoil 12 and the endwall 24 having increased material. The first or second endwall cooling channels 40, 42 provide additional internal convective cooling for the vane root section fillet region as well as soften the airfoil trailing edge root section stiffness. The construction technique increase the flexibility of the airfoil 12 trailing edge root section and lowers thermally induced strain. This translates to lower thermal stress and strain range for the airfoil root section, alleviates the crack initiation at the intersection 20 between the airfoil trailing edge 22 and the endwall 24 and provides for higher overall airfoil operating life.

The foregoing is provided for purposes of illustrating, explaining, and describing embodiments of this invention. Modifications and adaptations to these embodiments will be apparent to those skilled in the art and may be made without departing from the scope or spirit of this invention.

We claim:

1. A turbine airfoil assembly, comprising:

a generally elongated, hollow airfoil having a leading edge, a trailing edge, an endwall coupled to a first end of the generally elongated, hollow airfoil and extending generally orthogonal to a longitudinal axis of the generally elongated, hollow airfoil, and a cooling system formed from at least one cavity in the elongated, hollow airfoil;

a plurality of first endwall cooling channels extending in the endwall from a line aligned with a midchord region of the generally elongated, hollow airfoil to a trailing edge of the endwall, wherein the plurality of first endwall cooling channels are aligned with each other and have a density of first endwall cooling channels;

a plurality of second endwall cooling channels extending from the line aligned with the midchord region of the generally elongated, hollow airfoil to the trailing edge of the endwall, wherein the plurality of second endwall cooling channels are aligned with each other and have a density of second endwall cooling channels;

wherein the second endwall cooling channels are positioned in a trailing edge cooling region in the endwall, wherein the trailing edge cooling region is at least partially aligned with the intersection between the trailing edge of the generally elongated, hollow airfoil and the endwall;

wherein the density of the second endwall cooling channels is greater than the density of the first endwall cooling channels; and wherein the trailing edge cooling region having a density of second endwall cooling channels in the endwall is defined by a plurality of cooling channels aligned with each other and positioned between a second endwall cooling channel that is positioned radially inward from an outer surface of a suction side of the airfoil and that is positioned between the trailing edge and a first side edge of the endwall closest to the suction side of the airfoil, and a second endwall cooling channel that is positioned closer to an opposite second side edge of the endwall and between the trailing edge and the opposite second side edge.

2. The turbine airfoil assembly of claim 1, wherein the trailing edge cooling region in the endwall includes at least one second endwall cooling channel in the endwall generally aligned with a first side edge of the endwall.

3. The turbine airfoil assembly of claim 1, wherein the second endwall cooling channels in the trailing edge cooling region have a pitch to diameter ratio of 2 to 3.

4. The turbine airfoil assembly of claim 1, wherein the first endwall cooling channels in the trailing edge cooling region have a pitch to diameter ratio of 8 to 10.

5. The turbine airfoil assembly of claim 1, wherein the plurality of second endwall cooling channels form between 40 percent and 50 percent of a width of the trailing edge of the endwall.

6. The turbine airfoil assembly of claim 1, wherein the density of second endwall cooling channels is at least twice that of the density of first endwall cooling channels.

7. The turbine airfoil assembly of claim 1, wherein a width of the trailing edge cooling region taken in a direction extending from a first side edge of the endwall to a second side edge of the endwall is between two times a width of the trailing edge of the airfoil and five times a width of the trailing edge of the airfoil.

8. The turbine airfoil assembly of claim 7, wherein the trailing edge cooling region is positioned such that a width of the trailing edge cooling region equal to the width of one trailing edge of the airfoil is positioned in the endwall between the trailing edge of the arifoil at a suction side and the first side edge of the endwall, and the trailing edge cooling region is positioned such that a remainder of the width of the trailing edge cooling region extends from the trailing edge of the airfoil at the suction side towards the second side edge of the endwall.

9. The turbine airfoil assembly of claim 1, wherein a centerline of the first and second endwall cooling channels is positioned between a centerline of a thickness of the endwall and a radially outer surface of the endwall to which the airfoil is coupled.

10. The turbine airfoil assembly of claim 1, wherein the endwall includes two generally hollow airfoils extending radially outward therefrom and wherein the endwall includes a trailing edge cooling region at the trailing edge of each of the generally hollow airfoils.

11. A turbine airfoil assembly, comprising:

a generally elongated, hollow airfoil having a leading edge, a trailing edge, an endwall coupled to a first end of the generally elongated, hollow airfoil and extending generally orthogonal to a longitudinal axis of the generally elongated, hollow airfoil, and a cooling system formed from at least one cavity in the elongated, hollow airfoil;

a plurality of first endwall cooling channels extending in the endwall from a line aligned with a midchord region of the generally elongated, hollow airfoil to a trailing edge of the endwall, wherein the plurality of first endwall cooling channels are aligned with each other and have a density of first endwall cooling channels;

a plurality of second endwall cooling channels extending from the line aligned with the midchord region of the generally elongated, hollow airfoil to the trailing edge of the endwall, wherein the plurality of second endwall cooling channels are aligned with each other and have a density of second endwall cooling channels;

wherein the second endwall cooling channels are positioned in a trailing edge cooling region in the endwall, wherein the trailing edge cooling region is at least partially aligned with the intersection between the trailing edge of the generally elongated, hollow airfoil and the endwall;

wherein the density of the second endwall cooling channels is greater than the density of the first endwall cooling channels; and wherein a number of first endwall cooling channels is equal to a number of second endwall cooling channels in the endwall, whereby the first and second endwall cooling channels have equal diameters.

12. A turbine airfoil assembly, comprising:

a generally elongated, hollow airfoil having a leading edge, a trailing edge, an endwall coupled to a first end of the generally elongated, hollow airfoil and extending generally orthogonal to a longitudinal axis of the generally elongated, hollow airfoil, and a cooling system formed from at least one cavity in the elongated, hollow airfoil;

a plurality of first endwall cooling channels extending in the endwall from a line aligned with a midchord region of the generally elongated, hollow airfoil to a trailing edge of the endwall, wherein the plurality of first endwall cooling channels are aligned with each other and have a density of first endwall cooling channels;

a plurality of second endwall cooling channels extending from the line aligned with the midchord region of the generally elongated, hollow airfoil to the trailing edge of the endwall, wherein the plurality of second endwall cooling channels are aligned with each other and have a density of second endwall cooling channels;

wherein the second endwall cooling channels are positioned in a trailing edge cooling region in the endwall, wherein the trailing edge cooling region is at least partially aligned with the intersection between the trailing edge of the generally elongated, hollow airfoil and the endwall;

wherein the density of the second endwall cooling channels is greater than the density of the first endwall cooling channels;

wherein the trailing edge cooling region in the endwall includes at least one second endwall cooling channel in the endwall generally aligned with a first side edge of the endwall;

wherein the trailing edge cooling region is positioned such that a width of the trailing edge cooling region equal to the width of one trailing edge is positioned in the endwall between the trailing edge of the airfoil at a suction side and the first side edge of the endwall, and the trailing edge cooling region is positioned such that a remainder of the width of the trailing edge cooling region extends from the trailing edge of the airfoil at the suction side towards the second side edge of the endwall; and wherein the second endwall cooling channels in the trailing edge cooling region have a pitch to diameter ratio of 2 to 3.

13. The turbine airfoil assembly of claim 12, wherein a width of the trailing edge cooling region taken in a direction extending from a first side edge of the endwall to a second side edge of the endwall is between two times a width of the trailing edge of the airfoil and five times a width of the trailing edge of the airfoil.

14. The turbine airfoil assembly of claim 12, wherein the endwall includes two generally hollow airfoils extending radially outward therefrom and wherein the endwall includes a trailing edge cooling region at a trailing edge of each of the generally hollow airfoils.

15. A turbine airfoil assembly, comprising:

a generally elongated, hollow airfoil having a leading edge, a trailing edge, an endwall coupled to a first end of the generally elongated, hollow airfoil and extending generally orthogonal to a longitudinal axis of the generally elongated, hollow airfoil, and a cooling system formed from at least one cavity in the elongated, hollow airfoil;

a plurality of first endwall cooling channels extending in the endwall from a line aligned with a midchord region of the generally elongated, hollow airfoil to a trailing edge of the endwall, wherein the plurality of first endwall cooling channels are aligned with each other and have a density of first endwall cooling channels;

a plurality of second endwall cooling channels extending from the line aligned with the midchord region of the generally elongated, hollow airfoil to the trailing edge of the endwall, wherein the plurality of second endwall cooling channels are aligned with each other and have a density of second endwall cooling channels;

wherein the second endwall cooling channels are positioned in a trailing edge cooling region in the endwall, wherein the trailing edge cooling region is at least partially aligned with the intersection between the trailing edge of the generally elongated, hollow airfoil and the endwall;

wherein the density of the second endwall cooling channels is greater than the density of the first endwall cooling channels;

wherein the trailing edge cooling region in the endwall includes at least one second endwall cooling channel in the endwall generally aligned with a first side edge of the endwall, wherein the trailing edge cooling region is positioned such that a width of the trailing edge cooling region equal to the width of one trailing edge is positioned in the endwall between the trailing edge of the airfoil at a suction side and the first side edge of the endwall, and the trailing edge cooling region is positioned such that a remainder of the width of the trailing edge cooling region extends from the trailing edge of the airfoil at the suction side towards the second side edge of the endwall; and wherein the first endwall cooling channels in the trailing edge cooling region have a pitch to diameter ratio of 8 to 10.

16. The turbine airfoil assembly of claim 15, wherein a width of the trailing edge cooling region taken in a direction extending from a first side edge of the endwall to a second side edge of the endwall is between two times a width of the trailing edge of the airfoil and five times a width of the trailing edge of the airfoil.

17. The turbine airfoil assembly of claim 15, wherein the endwall includes two generally hollow airfoils extending radially outward therefrom and wherein the endwall includes a trailing edge cooling region at a trailing edge of each of the generally hollow airfoils.

18. A turbine airfoil assembly, comprising:

a generally elongated, hollow airfoil having a leading edge, a trailing edge, an endwall coupled to a first end of the generally elongated, hollow airfoil and extending generally orthogonal to a longitudinal axis of the generally elongated, hollow airfoil, and a cooling system formed from at least one cavity in the elongated, hollow airfoil;

a plurality of first endwall cooling channels extending in the endwall from a line aligned with a midchord region of the generally elongated, hollow airfoil to a trailing edge of the endwall, wherein the plurality of first endwall cooling channels are aligned with each other and have a density of first endwall cooling channels;

a plurality of second endwall cooling channels extending from the line aligned with the midchord region of the generally elongated, hollow airfoil to the trailing edge of the endwall, wherein the plurality of second endwall cooling channels are aligned with each other and have a density of second endwall cooling channels;

wherein the second endwall cooling channels are positioned in a trailing edge cooling region in the endwall, wherein the trailing edge cooling region is at least partially aligned with the intersection between the trailing edge of the generally elongated, hollow airfoil and the endwall;

wherein the density of the second endwall cooling channels is greater than the density of the first endwall cooling channels;

wherein the trailing edge cooling region in the endwall includes at least one second endwall cooling channel in the endwall generally aligned with a first side edge of the endwall;

wherein the trailing edge cooling region is positioned such that a width of the trailing edge cooling region equal to the width of one trailing edge is positioned in the endwall between the trailing edge of the airfoil at a suction side and the first side edge of the endwall, and the trailing edge cooling region is positioned such that a remainder of the width of the trailing edge cooling region extends from the trailing edge of the airfoil at the suction side towards the second side edge of the endwall; and wherein the density of second endwall cooling channels is at least twice that of the density of first endwall cooling channels.

19. The turbine airfoil assembly of claim 18, wherein a width of the trailing edge cooling region taken in a direction extending from a first side edge of the endwall to a second side edge of the endwall is between a two times a width of the trailing edge of the airfoil and five times a width of the trailing edge of the airfoil.

20. The turbine airfoil assembly of claim 18, wherein the endwall includes two generally hollow airfoils extending radially outward therefrom and wherein the endwall includes a trailing edge cooling region at a trailing edge of each of the generally hollow airfoils.

* * * * *